US008758089B2

(12) United States Patent
Annen et al.

(10) Patent No.: US 8,758,089 B2
(45) Date of Patent: Jun. 24, 2014

(54) ABRASIVE ARTICLES, ROTATIONALLY RECIPROCATING TOOLS, AND METHODS

(75) Inventors: Michael John Annen, Hudson, WI (US); Peter Atanacio Felipe, Sr., Saint Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/563,986

(22) Filed: Aug. 1, 2012

(65) Prior Publication Data

US 2012/0295525 A1 Nov. 22, 2012

Related U.S. Application Data

(63) Continuation of application No. 11/689,250, filed on Mar. 21, 2007, now abandoned.

(51) Int. Cl.
*B24B 23/04* (2006.01)

(52) U.S. Cl.
USPC ..... 451/28; 451/357

(58) Field of Classification Search
USPC ..... 451/357, 356, 344, 351, 350, 354, 358, 451/163, 28
See application file for complete search history.

(56) References Cited

U.S. PATENT DOCUMENTS

| | | | | |
|---|---|---|---|---|
| 2,350,098 | A | 5/1944 | Decker | |
| 2,794,303 | A | 6/1957 | Wickes | |
| 2,958,166 | A * | 11/1960 | Foland | 451/490 |
| 3,041,156 | A | 6/1962 | Rowse | |
| 3,082,582 | A * | 3/1963 | Jeske | 451/490 |
| 3,270,467 | A | 9/1966 | Block et al. | |
| 3,395,417 | A * | 8/1968 | Matouka | 15/230 |
| 3,418,675 | A | 12/1968 | Meguiar et al. | |
| 3,562,968 | A | 2/1971 | Johnson et al. | |
| 3,667,170 | A | 6/1972 | Mackay, Jr. | |
| 3,924,362 | A * | 12/1975 | McAleer | 451/490 |
| 4,314,827 | A | 2/1982 | Leitheiser et al. | |
| 4,588,419 | A | 5/1986 | Caul et al. | |
| 4,623,364 | A | 11/1986 | Cottringer et al. | |
| 4,734,104 | A | 3/1988 | Broberg | |
| 4,737,163 | A | 4/1988 | Larkey | |
| 4,744,802 | A | 5/1988 | Schwabel | |
| 4,751,138 | A | 6/1988 | Tumey et al. | |
| 4,770,671 | A | 9/1988 | Monroe et al. | |
| 4,854,085 | A | 8/1989 | Huber | |
| 4,881,951 | A | 11/1989 | Wood et al. | |
| 4,927,431 | A | 5/1990 | Buchanan et al. | |
| 4,962,562 | A | 10/1990 | Englund et al. | |
| 4,985,340 | A | 1/1991 | Palazzotto et al. | |
| 4,997,461 | A | 3/1991 | Markhoff-Matheny et al. | |
| 5,009,675 | A | 4/1991 | Kunz et al. | |
| 5,011,508 | A | 4/1991 | Wald et al. | |

(Continued)

FOREIGN PATENT DOCUMENTS

| | | |
|---|---|---|
| EP | 0306161 | 3/1989 |
| EP | 0306162 | 3/1989 |

(Continued)

*Primary Examiner* — Robert Rose
(74) *Attorney, Agent, or Firm* — Aleksander Medved

(57) ABSTRACT

Methods of abrading surfaces by rotationally reciprocating abrasive surfaces in contact with the surfaces, abrasive articles for use in rotationally reciprocating tools, and methods of removing defects in a surface, where the methods include sanding using a rotationally reciprocating abrasive surface followed by one or more polishing operations are disclosed.

18 Claims, 4 Drawing Sheets

(56) References Cited

U.S. PATENT DOCUMENTS

| | | | |
|---|---|---|---|
| 5,014,468 | A | 5/1991 | Ravipati et al. |
| 5,042,991 | A | 8/1991 | Kunz et al. |
| 5,054,149 | A | 10/1991 | Si-Hoe et al. |
| 5,078,753 | A | 1/1992 | Broberg et al. |
| 5,085,671 | A | 2/1992 | Martin et al. |
| 5,123,216 | A | 6/1992 | Kloss et al. |
| 5,152,917 | A | 10/1992 | Pieper et al. |
| 5,203,884 | A | 4/1993 | Buchanan et al. |
| 5,209,022 | A | 5/1993 | McCambridge |
| 5,213,591 | A | 5/1993 | Celikkaya et al. |
| 5,292,352 | A | 3/1994 | Rudolf et al. |
| 5,304,223 | A | 4/1994 | Pieper et al. |
| 5,311,633 | A | 5/1994 | Herzog et al. |
| 5,366,523 | A | 11/1994 | Rowenhorst et al. |
| 5,378,251 | A | 1/1995 | Culler et al. |
| 5,396,737 | A | 3/1995 | Englund et al. |
| 5,417,726 | A | 5/1995 | Stout et al. |
| 5,435,816 | A | 7/1995 | Spurgeon et al. |
| 5,436,063 | A | 7/1995 | Follett et al. |
| 5,454,844 | A | 10/1995 | Hibbard et al. |
| 5,482,499 | A | 1/1996 | Satoh |
| 5,490,878 | A | 2/1996 | Peterson et al. |
| 5,496,386 | A | 3/1996 | Broberg et al. |
| 5,520,711 | A | 5/1996 | Helmin |
| 5,520,957 | A | 5/1996 | Bange et al. |
| 5,549,962 | A | 8/1996 | Holmes et al. |
| 5,609,706 | A | 3/1997 | Benedict et al. |
| 5,637,034 | A | 6/1997 | Everts et al. |
| 5,672,097 | A | 9/1997 | Hoopman |
| 5,672,186 | A | 9/1997 | Chesley et al. |
| 5,681,213 | A | 10/1997 | Hashii |
| 5,681,217 | A | 10/1997 | Hoopman et al. |
| 5,700,302 | A | 12/1997 | Stoetzel et al. |
| 5,766,277 | A | 6/1998 | DeVoe et al. |
| 5,822,821 | A | 10/1998 | Sham |
| 5,846,123 | A | 12/1998 | Brown et al. |
| 5,851,247 | A | 12/1998 | Stoetzel et al. |
| 5,910,471 | A | 6/1999 | Christianson et al. |
| 5,913,716 | A | 6/1999 | Mucci et al. |
| 5,919,085 | A | 7/1999 | Izumisawa |
| 5,942,015 | A | 8/1999 | Culler et al. |
| 5,954,844 | A | 9/1999 | Law et al. |
| 5,958,794 | A | 9/1999 | Bruxvoort et al. |
| 5,961,674 | A | 10/1999 | Gagliardi et al. |
| 5,962,120 | A | 10/1999 | Keipert |
| 5,975,988 | A | 11/1999 | Christianson |
| 5,994,450 | A | 11/1999 | Pearce |
| 6,013,711 | A | 1/2000 | Lewis et al. |
| 6,059,850 | A | 5/2000 | Lise et al. |
| 6,077,601 | A | 6/2000 | DeVoe et al. |
| 6,099,397 | A | 8/2000 | Wurst |
| 6,139,594 | A | 10/2000 | Kincaid et al. |
| 6,228,133 | B1 | 5/2001 | Thurber et al. |
| 6,261,682 | B1 | 7/2001 | Law |
| 6,277,160 | B1 | 8/2001 | Stubbs et al. |
| 6,306,023 | B1 | 10/2001 | Gmeilbauer |
| 6,371,837 | B1 * | 4/2002 | Luedeke ..... 451/57 |
| 6,797,765 | B2 | 9/2004 | Pearce |
| 6,846,232 | B2 | 1/2005 | Braunschweig et al. |
| 6,908,979 | B2 | 6/2005 | Arendoski |
| 6,923,840 | B2 | 8/2005 | Schutz et al. |
| 6,929,539 | B2 | 8/2005 | Schutz et al. |
| 7,121,924 | B2 | 10/2006 | Fritz et al. |
| 7,404,988 | B2 | 7/2008 | Kuta |
| 8,057,281 | B2 | 11/2011 | Annen et al. |
| 2001/0041511 | A1 | 11/2001 | Lack et al. |
| 2003/0022604 | A1 | 1/2003 | Annen et al. |
| 2003/0207659 | A1 | 11/2003 | Annen et al. |

FOREIGN PATENT DOCUMENTS

| | | |
|---|---|---|
| JP | 60016359 | 1/1985 |
| JP | 07000642 U | 1/1995 |
| JP | 08-039400 | 2/1996 |
| JP | 2004050355 | 2/2004 |
| JP | 2005118917 | 5/2005 |
| JP | 2006055978 | 3/2006 |
| JP | 2007038371 | 2/2007 |
| RU | 2158852 | 11/2000 |
| RU | 2289501 | 12/2006 |

* cited by examiner

ABRASIVE ARTICLES, ROTATIONALLY RECIPROCATING TOOLS, AND METHODS

CROSS REFERENCE TO RELATED APPLICATIONS

This application is a continuation of U.S. application Ser. No. 11/689,250, filed Mar. 21, 2007, now abandoned the disclosure of which is incorporated by reference in their entirety herein.

To protect and preserve the aesthetic qualities of the finish on an automobile or other vehicle, it is generally known to provide a clear (non-pigmented or slightly pigmented) topcoat over a colored (pigmented) basecoat, so that the basecoat remains unaffected even during prolonged exposure to the environment or weathering. Generally in the art, this is known as a basecoat/topcoat or basecoat/clearcoat finish. The resulting finish is not typically completely smooth (due to, e.g., the spraying conditions, the composition of the topcoat or clearcoat, drying conditions, topography of the underlying surface, etc.). Rather than being perfectly smooth, the clearcoat or topcoat finish typically exhibits a texture that is somewhat similar to the texture seen in the peel of an orange. That texture is commonly referred to as an "orange-peel" finish and is acceptable in most situations.

During application of each of these coats, or during repair thereof, dust, dirt or other particles may, however, get caught in the finish, resulting in defects such as protrusions, etc. in the finish (commonly referred to as "nibs"). The defects typically detract from the appearance of the orange-peel finish to a degree that is not acceptable.

Removal of unacceptable defects (commonly referred to as "de-nibbing") is typically accomplished by relatively aggressive abrading methods that affect areas of the surface that are significantly larger than the defect itself. As a result, the repairs themselves may cause flat spots in the characteristic orange-peel appearance of areas adjacent to the removed defects. Those flat spots in the orange-peel texture may, in some instances, also be unacceptable. To avoid flat spots in the orange-peel texture, a technician may even be required to repair a full body panel, instead of repairing the individual defects. Such extensive refinishing can significantly increase the time, energy and cost of removing/repairing defects such as nibs in a finish.

More generally, the same issues of blending the surface appearance between refinished and non-refinished areas on a surface may also arise in many other conventional abrading processes such as, for example, those processes involving coated abrasive products.

SUMMARY OF THE INVENTION

The present invention provides methods of abrading surfaces by rotationally reciprocating abrasive surfaces in contact with the surfaces. The present invention may also provide abrasive articles for use in rotationally reciprocating tools. In addition, the present invention may also provide methods of removing defects in a surface, where the method includes sanding (using a rotationally reciprocating abrasive surface) followed by one or more polishing operations.

As used herein, "rotational reciprocation" (and variations thereof) is used to describe rotation of an abrasive article about an axis of rotation in alternating clockwise and counterclockwise directions. In other words, the abrasive article is first rotated in a first direction about an axis of rotation, stopped, rotated in an opposite direction, stopped, etc.

Rotational reciprocation of abrasive articles may provide advantages in the removal of smaller defects (e.g., nibs, protrusions, etc.) from a surface as compared to conventional processes involving, e.g., rotating abrasive articles. Those advantages may include, e.g., reduced disturbance of any orange-peel texture in the surface surrounding the defect, reductions in the number of steps required to complete the repair, reductions in the total area affected by the repair, etc.

Limiting disturbance of the orange-peel texture in the surface finish while still effectively removing the surface defect may, in many instances, allow removal of such defects without requiring treatment of the entire surface to avoid introducing flat spots that are unacceptable in size and/or frequency in the orange-peel texture.

Also among the potential advantages of the present invention is the opportunity to reduce the number of steps required to repair surface defects on, e.g., a finished surface (where the finish is, e.g., a clear-coat, paint, varnish, etc.). Conventional methods of removing such defects (sometimes referred to in the automotive industry as "denibbing") can require up to five steps to achieve an acceptable result. The conventional process typically includes: 1) sanding (to remove the protrusions); 2) scratch refinement (to remove more prominent sanding scratches); 3) compounding (to further remove sanding scratches); 4) polishing (to polish finish after steps 2 & 3); and 5) swirl elimination (to remove swirl marks left after polishing).

Because the pads on tools used to perform the sanding are typically large (e.g., with diameters in the range of 6-9 inches (15.2-22.9 centimeters), the resulting areas on which steps 1-5 must be performed are also large because the size of the pads makes it nearly impossible to avoid affecting large areas of the surface from which defects are being removed. In some instances, it is as economical to refinish entire body panels using the steps described above (especially where the orange-peel texture in the finish has been removed in large areas).

In contrast, the abrasive articles and rotationally reciprocating tools of the present invention may provide a user with the ability to repair surface defects in a fraction of the time required in the conventional 5-step process. Using the present invention, defects may be repaired (with limited impact on the orange-peel texture) by sanding (by rotationally reciprocating the abrasive articles and tools described herein) followed by one or more polishing operations. It may be preferred that the sanding be followed by an initial polishing step, followed by at least one subsequent polishing operation to remove swirl marks left after the initial polishing operation. In other words, the conventional five-step process can be performed in two or three steps.

Furthermore, because the size of the area affected during the removal of each of the defects is relatively small, disturbance of the orange-peel texture around the defect is significantly reduced as compared to defect removal (e.g., denibbing) techniques using conventional larger tools. As a result, the likelihood that an entire body panel would need to be refinished because of noticeable orange-peel flattening around each of the defects may be significantly reduced.

To minimize the size of the area affected during the refinishing process, it may be preferred to use abrasive articles with smaller abrasive surfaces as described herein. It may, for example, be preferred to use abrasive surfaces with a size of about 500 square millimeters ($mm^2$) or less, in some instances about 300 $mm^2$ or less, or even about 150 $mm^2$ or less. With such small abrasive surfaces, however, conventional rotary sanding processes in which the abrasive surface is rotated at relatively high speeds would typically provide more energy than is required to remove the defect. That excessive energy also typically results in undesirable heat generation, deeper scratches, and/or more aggressive removal of material than is required—particularly when removing small surface defects.

The rotating reciprocation of an abrasive article as discussed in connection with the present invention can, however, provide enough abrasive energy to remove the defect. The amount of abrasive energy is not so great, however, that the scratches and/or material removal are excessive. In other words, the scratches formed using a rotationally reciprocating tool may be shallower than those that would be formed using a rotating sanding tool. The shallower scratches may preferably require less extensive refinishing as compared to more conventional sanding/refinishing methods.

The rate at which the abrasive articles may be reciprocated can vary based on a variety of factors (e.g., the surface being abraded, the size of the abrasive article, desired rate of abrasion, etc.). It may be preferred that the reciprocating be performed at a frequency of at least about 60 cycles per minute (i.e., 1 Hertz) or higher (where a cycle is a change in direction of rotation). In some instances, it may be preferred that the reciprocating frequency be 2 Hz or higher, 100 Hz or higher, 500 Hz or higher, 1000 Hz or higher, or even 2000 Hz or higher.

In one aspect, the present invention may provide a method of abrading a surface of a workpiece. The method includes providing an abrasive article mounted on a shaft of a driven tool, wherein the abrasive article has an abrasive surface with abrasive particles attached thereto; contacting the surface of the workpiece with the abrasive surface of the abrasive article; and rotationally reciprocating the abrasive surface of the abrasive article about an axis of rotation by rotationally reciprocating the shaft of the driven tool, wherein the surface of the workpiece is abraded by the abrasive particles attached to the abrasive surface of the abrasive article while the abrasive surface of the abrasive article is rotationally reciprocating about the axis of rotation.

In another aspect, the present invention may provide a conformable abrasive article that includes a base plate having a mounting surface; a resiliently compressible member attached to the mounting surface of the base plate, wherein the compressible member has a first major surface facing the mounting surface and a second major surface facing away from the mounting surface, and wherein the first major surface and the second major surface of the compressible member are each as large or larger than the mounting surface of the base plate; a flexible support layer attached to the compressible member, wherein the support layer has a first major surface facing the compressible member and a second major surface facing away from the compressible member, and wherein the first major surface and the second major surface of the support layer are each larger than the second major surface of the compressible member; and an abrasive member attached to the second major surface of the support layer such that an abrasive surface of the abrasive member faces away from the compressible member and the base plate, and wherein the abrasive surface has a flat abrasive surface that is coextensive with the second major surface of the support layer.

In another aspect, the present invention may provide a abrasive tool that includes a powered device having an output shaft adapted to rotationally reciprocate about an axis of rotation; and an abrasive article with an abrasive surface that includes abrasive particles, wherein the abrasive article is attached the output shaft, wherein rotational reciprocation of the output shaft rotationally reciprocates the abrasive article about the axis of rotation.

In another aspect, the present invention may provide a method of repairing defects in a workpiece surface. The method includes sanding one or more defects in a workpiece surface by rotationally reciprocating an abrasive surface of an abrasive article about an axis of rotation using the shaft of the driven tool, wherein the workpiece surface is abraded by abrasive particles attached to the abrasive surface of the abrasive article while the abrasive surface of the abrasive article is rotationally reciprocating about the axis of rotation; and polishing an area of the workpiece surface surrounding and containing each of the one or more defects by contacting the workpiece surface with a working surface of a pad, wherein the working surface of the pad is rotated in one direction about an axis of rotation extending through the workpiece surface and working surface of the pad, wherein an abrasive slurry is forced against the workpiece surface by the working surface of the pad, and wherein the abrasive slurry contains abrasive particles that are finer than the abrasive particles attached to the abrasive surface of the abrasive article.

In another aspect, the present invention may provide a method of repairing defects in a workpiece surface. The method includes sanding one or more defects in a workpiece surface by rotationally reciprocating an abrasive surface of an abrasive article about an axis of rotation using the shaft of the driven tool, wherein the workpiece surface is abraded by abrasive particles attached to the abrasive surface of the abrasive article while the abrasive surface of the abrasive article is rotationally reciprocating about the axis of rotation, and wherein rotationally reciprocating the abrasive surface comprises reciprocating the abrasive surface at a frequency of 1 Hz or higher. The method further includes polishing an area of the workpiece surface surrounding and containing each of the one or more defects after the sanding by contacting the workpiece surface with a working surface of a pad, wherein the working surface of the pad is rotated in one direction about an axis of rotation extending through the workpiece surface and working surface of the pad, and wherein an abrasive slurry is forced against the workpiece surface by the working surface of the pad, and wherein the abrasive slurry contains abrasive particles that are finer than the abrasive particles attached to the abrasive surface of the abrasive article. The method still further includes one or more subsequent polishing operations performed on each area surrounding and containing the one or more defects, wherein each of the one or more subsequent polishing operations comprises contacting the workpiece surface with a working surface of pad, wherein the working surface of the pad is rotated in one direction about an axis of rotation extending through the workpiece surface and working surface of the pad, wherein an abrasive slurry is forced against the workpiece surface by the working surface of the pad, and wherein the abrasive slurry used in each of the subsequent polishing operations contains abrasive particles that are finer than abrasive particles contained in the abrasive slurry used in a preceding polishing operation on the same area.

As used herein, "resiliently compressible" (and variations thereof) means reducible in volume by at least 10% in response to an applied compressive force, and further wherein the compressed article regains at least 50% of the reduced volume after removal of the compressive force within one minute or less.

As used herein, a "flat abrasive surface" means that the abrasive surface generally defines a plane (in the absence of some deforming mechanical force acting on the abrasive surface) such that, when applied to a flat workpiece surface, rotation of the abrasive surface typically results in some contact between the abrasive surface and the workpiece surface over substantially all of the area of the workpiece surface that faces the abrasive surface. It should be understood that a flat abrasive surface may include structures, particles, peaks and valleys, undulations, etc. such that not all of the workpiece surface is in actual contact with flat abrasive surface at all times. Further, such structures, particles, peaks and valleys, undulations, etc. are not all necessarily located in the plane, but those features will, collectively, define a plane over the entire abrasive surface (where the defined plane may have a limited thickness in view of minor variations in the height of the features defining the plane). Examples of some flat abrasive surfaces are depicted in FIGS. 10A-10C.

As used herein, the phrase "attached to" means attached directly to as well as attached to an intervening component/layer. For example, first and second components attached to each other may be in direct contact with each other or they may be attached to one or more intervening components/layers located between the first and second components.

As used herein, the phrase "major surface" is used to refer to surfaces that define the thickness of an article—the phrase is typically used in connection with films, disc-shaped articles, etc. to refer to the flat surfaces between which the thickness of the article is defined. For example, a sheet of paper includes two major surfaces and an edge surface extending between the two major surfaces.

This summary is not intended to describe each embodiment or every implementation of the present invention. Rather, a more complete understanding of the invention will become apparent and appreciated by reference to the following Detailed Description of Exemplary Embodiments and claims in view of the accompanying figures of the drawing.

BRIEF DESCRIPTION OF THE VIEWS OF THE DRAWING

The present invention will be further described with reference to the figures of the drawing, wherein.

DETAILED DESCRIPTION OF EXEMPLARY EMBODIMENTS OF THE INVENTION

Figure 1:
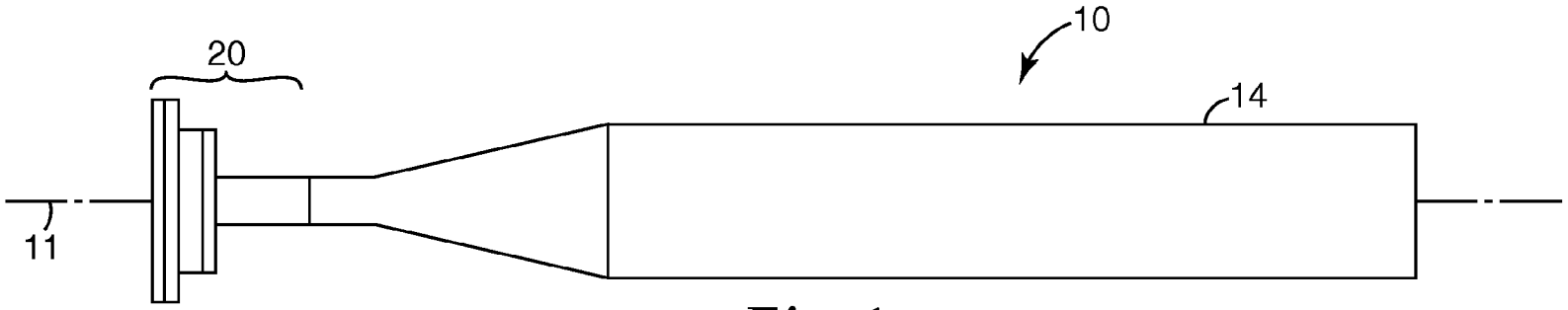
FIG. 1 is a side view of one exemplary driven tool with an attached abrasive article.

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

Figure 2:
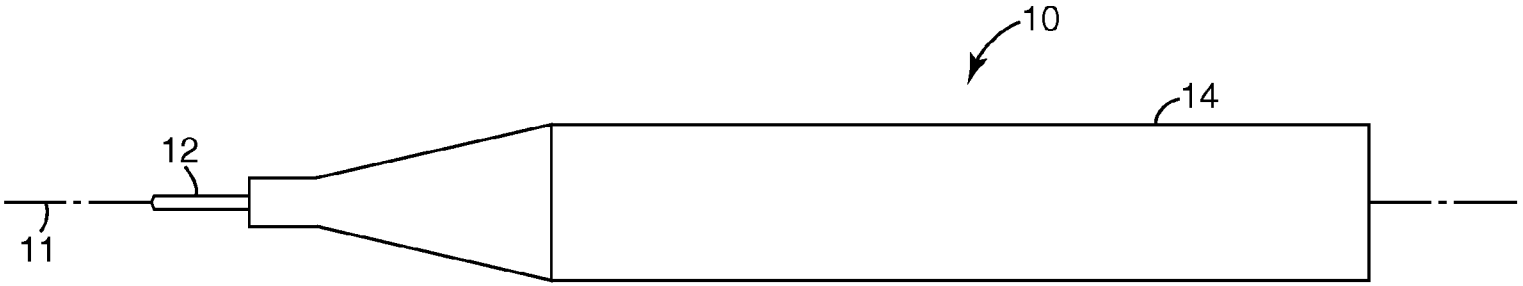
FIG. 2 is a side view of the driven tool of FIG. 1 with the abrasive article removed to expose the rotationally reciprocating shaft of the driven tool.

FIG. 1 depicts an exemplary driven tool 10 and attached abrasive article 20 that may be used in connection with the present invention. FIG. 2 depicts the driven tool 10 with the abrasive article 20 removed, exposing a shaft 12 extending out of the housing 14 of the driven tool 10. In some embodiments, the shaft 12 may be partially protected by or enclosed within a shroud (not shown) to protect the shaft from damage if, e.g., the tool 10 is dropped, etc.

Although not depicted in FIGS. 1 & 2, the driven tool 10 may preferably include a motor, transmission (if required), power source (e.g., batteries, etc.) within the housing 14 such that the driven tool 10 is a self-contained integral unit that need not be connected to an external power source, etc. In alternative embodiments, however, the driven tool 10 may be capable of connecting to an external power source (i.e., a power source that is not contained within the housing 14) to provide the energy required to move the shaft 12. Examples of some potentially suitable external power sources may be, e.g., pneumatic lines, hydraulic lines, electric power sources (e.g., external batteries, electric line voltage (e.g., 120/220 Volt, 60 Hz), etc.).

The driven tool 10 preferably causes rotational reciprocation of the shaft 12 about the axis of rotation 11. Rotational reciprocation of a shaft may be provided by a variety of tools and mechanisms, some of which have been developed in connection with powered handheld toothbrushes. Examples of some potentially suitable driven tools capable of providing rotational reciprocation may be described in, e.g., U.S. Pat. No. 5,054,149 (Si-Hoe et al.); U.S. Pat. No. 5,311,633 (Herzog et al.); U.S. Pat. No. 5,822,821 (Sham); etc. Although the abrasive surfaces used in connection with the invention may preferably be oriented perpendicular to the axis about which the shaft 12 of the tool 10 rotates, the abrasive surfaces may alternatively have any selected orientation relative to the axis 11 about which shaft 12 rotates. Examples of mechanisms capable of reciprocally rotating a pad that is not perpendicular to the axis 11 may be found in, e.g., U.S. Pat. No. 5,054,149 (Si-Hoe et al.); U.S. Pat. No. 5,311,633 (Herzog et al.); U.S. Pat. No. 5,822,821 (Sham); etc. and those mechanisms may be used in connection with the present invention.

Figure 3:
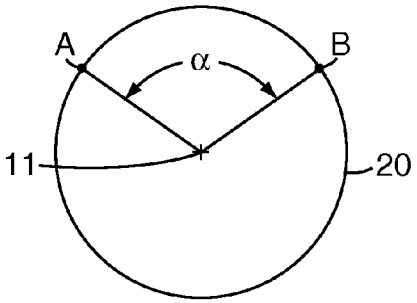
FIG. 3 is an enlarged end view of one exemplary abrasive surface on an exemplary abrasive article which also illustrates one exemplary range over which an abrasive surface may rotationally reciprocate during use.

The rotational reciprocation of the shaft 12 preferably causes corresponding rotational reciprocation of the abrasive article 20 attached or coupled to the shaft 12. FIG. 3 is an enlarged end view of the abrasive article 20 with axis of rotation 11 depicted as exiting from the page (preferably, as shown, located at the center of the abrasive article). The rotational reciprocation causes the abrasive article 20 to rotate about the axis of rotation in a manner that results in alternating clockwise and counter-clockwise rotation about the axis of rotation 11.

It may be preferred that the rotation in any one direction be limited to a selected range or arc. One example of such an arc is depicted in FIG. 3 as encompassing an angle $\alpha$ (alpha) extending between points A and B at the periphery of the abrasive article 20. In some embodiments, the arc over which the abrasive article 20 rotationally reciprocates may be less than 360 degrees, 180 degrees or less, or even 90 degrees or less. The arc may be fixed for any particular driven tool 10 such that the shaft 12 rotationally reciprocates over a given angular arc. Alternatively, the reciprocation arc length may be adjustable.

The reciprocating movement may have a frequency of at least about 60 cycles per minute or higher (i.e., 1 Hertz (Hz) or higher) (where a cycle is a change in direction of rotation). In some embodiments, the reciprocating frequency may be 2 Hz or higher, 100 Hz or higher, 500 Hz or higher, 1000 Hz or higher, or even 2000 Hz or higher. In some instances, the arc and the frequency of the reciprocations may be related, e.g., larger arcs may result in reduced frequencies, smaller arcs may result in higher frequencies, etc. The reciprocation frequency for any particular driven tool 10 may be fixed, although in some instance the user may be able to adjust the reciprocation frequency provided by the driven tool 10 (using, e.g., a variable speed motor, etc.).

Although the abrasive articles according to the present invention are depicted herein as having abrasive surfaces in the form of circular articles, the abrasive articles may be manufactured in any other suitable shape, although shapes approximating circles (e.g., hexagons, octagons, decagons, etc.) may be preferred.

Abrasive articles according to the present invention are useful for abrading (including finishing) a workpiece where the workpiece can be manufactured from any of a variety of types of material such as painted substrates (e.g., having a clear coat, base (color) coat, primer or e-primer), coated substrates (e.g., with polyurethane, lacquer, etc.), plastics (thermoplastic, thermosetting), reinforced plastics, metal, (carbon steel, brass, copper, mild steel, stainless steel, titanium and the like) metal alloys, ceramics, glass, wood, wood-like materials, composites, stones (including gem stones), stone-like materials, and combinations thereof. The workpiece may be flat or may have a shape or contour associated with it. Examples of common workpieces that may be abraded by the abrasive articles and methods of the invention include metal or wooden furniture, painted or unpainted motor vehicle surfaces (car doors, hoods, trunks, etc.), plastic automotive components (headlamp covers, tail-lamp covers, other lamp covers, arm rests, instrument panels, bumpers, etc.), flooring (vinyl, stone, wood and wood-like materials), counter tops, and other plastic components.

During abrading processes it may be desirable to provide a liquid to the surface of the workpiece and/or the abrasive surface. The liquid may include water and/or an organic compound, and additives such as defoamers, degreasers, liquids, soaps, corrosion inhibitors, and the like.

Figure 4:
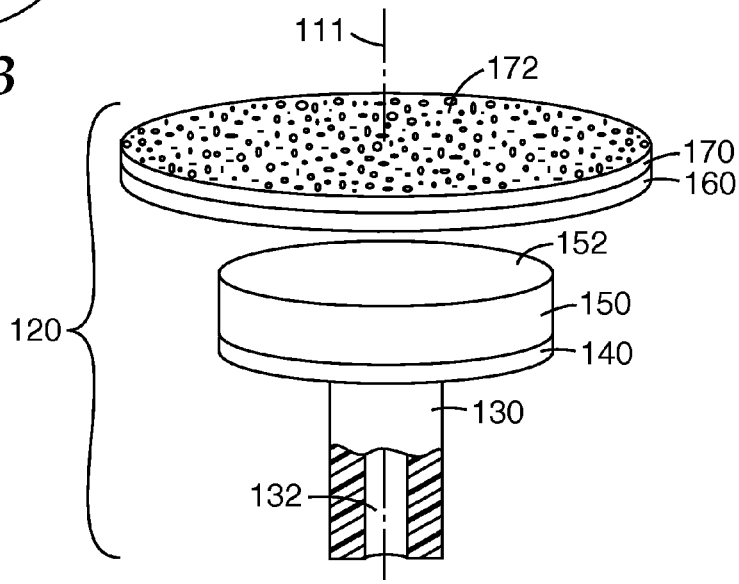
FIG. 4 is an exploded view of one exemplary abrasive article according to the present invention.

As depicted in FIGS. 1 & 2, it may be preferred that the abrasive article 20 be removably coupled to the shaft 12 such that the abrasive article 20 can be replaced after use. FIG. 4 is an enlarged perspective view of one abrasive article 120 that may be used in connection with a driven tool in the present invention.

Although the depicted abrasive article 120 includes a variety of components as discussed herein, one common component is a flat abrasive surface 172 arranged for use in connection with a driven tool as discussed herein. The flat abrasive surface 172 may preferably be oriented normal (i.e., orthogonal, perpendicular, etc.) to an axis of rotation 111 about which the abrasive surface is preferably rotationally reciprocated during use. In an abrasive article constructed of components with two opposing flat surfaces that are oriented parallel to each other (as depicted in FIG. 4), all of the major surfaces of the components may typically also be oriented normal to the axis of rotation 111. It should be noted that these surfaces are preferably flat in the absence of deformation by an external force acting on the abrasive article 120.

The depicted abrasive article 120 includes an optional sleeve coupling 130 that supports a rigid base plate 140. The sleeve coupling 130 and the rigid base plate 140 may preferably be formed as a unitary molded article, although in some embodiments the coupling 130 may be separate from the base plate 140 with the two components attached by any suitable attachment technique.

Also depicted in connection with the abrasive article 120 is an optional resiliently compressible member 150 attached to the mounting surface of the base plate 140. Although it is hidden by the compressible member 150 in FIG. 4, it will be understood that the mounting surface of the base plate 140 is the major surface of the base plate 140 that faces away from a shaft located in the coupling 130 and, correspondingly, that faces one of the major surfaces of the compressible member 150.

The abrasive article 120 of FIG. 4 also includes an optional flexible support layer 160 attached to the compressible member 150 (although in the exploded view of FIG. 4 the support layer 160 is detached from the compressible member 150). An abrasive member 170 with an abrasive surface 172 is attached to the major surface of the support layer 160 such that the abrasive surface 172 faces away from the compressible member 150.

The sleeve coupling 130 as depicted in FIG. 4 may preferably include a bore 132 in which the shaft of a driven tool (not shown) is retained such that movement of the shaft is transferred to the coupling 130 and the base plate 140 attached thereto. The bore 132 may, for example, have a shape complementary to the shaft of the driven tool such that the rotational reciprocating motion is transferred from the shaft to the sleeve coupling 130.

Although one example of a connection between the shaft of a driven tool and the abrasive article 120 is depicted in connection with FIGS. 1, 2, & 4, it should be understood that any connection technique/apparatus capable of transferring the rotational reciprocating motion could be used in place of that depicted. Examples of alternative attachments may include, e.g., friction fit components, threaded couplings, clamps, etc.

Although replacement of the entire abrasive article 120 may be preferred in some embodiments of the invention, in other embodiments, the base plate 140 may be fixedly attached to the shaft of the driven tool with replacement of the abrasive surface 172 being accomplished by replacement of other components in the system. For example, the compressible member 150 may be removably secured to the base plate 140, in which case replacement of the abrasive surface 172 would be accompanied by replacement of the support layer 160 and the compressible member 150. In still another alternative, the compressible member 150 may be fixedly attached to the base plate 140, such that replacement of the abrasive surface 172 is accomplished by removing the support layer 160 from the compressible member 150. In such an embodiment, the compressible member 150 would remain attached to the base plate 140. In yet another alternative, replacement of the abrasive surface 172 may be accomplished by removing the abrasive member 170 itself from the support layer 160.

A number of different techniques may be used to removably secure the different components in the abrasive article 120 to each other to provide the different options for replacement of the abrasive surface 172 discussed above. Examples of some potentially suitable attachment systems may include, e.g., adhesives, mechanical fastening systems (e.g., hook and loop fasteners, etc.), etc. Examples of some potentially suitable attachment systems may be described in, e.g., U.S. Pat. No. 3,562,968 (Johnson et al.); U.S. Pat. No. 3,667,170 (Mackay, Jr.); U.S. Pat. Nos. 3,270,467; 3,562,968 (Block et al.); and U.S. Pat. No. 5,672,186 (Chesley et al.); U.S. Patent Application Publication No. 2003/0143938 (Braunschweig et al.); U.S. patent application Ser. No. 10/828,119 (Fritz et al.), filed Apr. 20, 2004.

It is preferred that a majority (if not all) of the abrasive surface 172 of the abrasive article 120 be maintained in contact with the surface of a workpiece to be abraded even if the axis of rotation 111 about which the abrasive surface 172 is rotationally reciprocating is canted relative to (i.e., is not normal to) the workpiece surface. The interaction of the various components provided in the abrasive articles of the present invention preferably provides an abrasive article 120 in which one or more of the components can compress or deform such that the contact between the abrasive surface 172 and the workpiece surface is facilitated even if the axis of rotation is somewhat canted.

With respect to the abrasive article 120, a significant portion of any such deformation may preferably occur in the compressible member 150. In some embodiments, however, additional deformation may also occur in one or more other components of the abrasive article 120. For example, the base plate 140 may exhibit some flexibility in response to applied forces during use of the abrasive article 120 (although in some embodiments, the base plate 140 may preferably be rigid—i.e., the base plate 140 may preferably exhibit no significant deformation to the forces encountered in routine use).

The support layer 160 may also/alternatively exhibit compressibility in response to forces applied on the abrasive surface 172. As discussed below, the support layer 160 may, for example, be constructed of a compressible foam material. Although compressibility may be optional, the support layer 160 is preferably resiliently flexible such that it can bend and elastically deform in response to forces encountered during use of the abrasive article.

The support layer 160 provides some support to the abrasive member 170 outside of the area occupied by the compressible member 150, but preferably allows more deflection of the abrasive surface 172 than the compressible layer 150. In other words, it is preferred that the support offered to the abrasive member 170 by the underlying components to which it is attached is lower at the perimeter of the abrasive member 170 than in the center of the abrasive member 170.

In the depicted embodiment, the major surface of the compressible member 150 that faces the mounting surface of the base plate 140 is preferably as large or larger than the mounting surface of the base plate 140. Similarly, the major surface 152 of the compressible member 150 that faces away from the base plate 140 is also preferably as large or larger than the mounting surface of the base plate 140. By providing a compressible member 150 that is at least as large as the mounting surface of the base plate 140, adverse effects from the concentration of forces at the perimeter of the base plate 140 (e.g., excessive gouging, scratching, etc.) may be reduced or eliminated because of the deformation in the compressible member 150.

In a similar manner, the addition of a support layer 160 that is also compressible may serve to further reduce or eliminate adverse effects that might otherwise occur at the perimeter of the compressible member 150. It should, however, be understood that compressibility of the support layer 160 may be optional in those embodiments in which the compressible member 150 has characteristics that mitigate the need for additional compressibility in the support layer 160. In some embodiments of the invention, the support layer 160 may itself be optional where, e.g., the abrasive member 170 is capable of providing sufficient support outside of the area occupied by the support layer 160.

Because the support layer 160 is provided to offer additional support to the abrasive member 170 outside of the major surfaces of the compressible member 150, it is typically preferred that the major surfaces of the support layer 160 (i.e., the surfaces facing towards and away from the compressible member 150) be larger than the major surface 152 of the compressible member 150. It may be preferred that the major surface 152 of the compressible member 150 occupy less than 75% (or even less than 50%) of the major surface of the support layer 160 that faces the compressible member 150 (or the major surface of the abrasive member 170 facing the compressible member 150 if no support layer 160 is present).

It may further be preferred that the major surfaces of the support layer 160 be as large as the major surface of the abrasive member 170 attached to the support layer 160 (i.e., the facing major surfaces of the support layer 160 and the abrasive member 170 may preferably be coextensive with each other). Alternatively, the major surface of the support layer 160 may occupy at least 90% of the major surface of the abrasive member 170 that faces the support layer.

Although the base plate 140, compressible member 150, support layer 160, and abrasive member 170 are separate and discrete articles in the abrasive article 120, in some embodiments one or more of these components may alternatively be combined into unitary articles. For example, it may be possible to construct a single unitary article that provides compressible support in the central portion of the abrasive surface 172 and reduced support when moving away from the central portion of the abrasive surface 172 such that, e.g., the compressible member 150 and the support layer 160 can be replaced by a single unitary article. In another example, it may be possible to combine the functions of the support layer 160 and abrasive member 170 into a unitary article.

Figure 5:
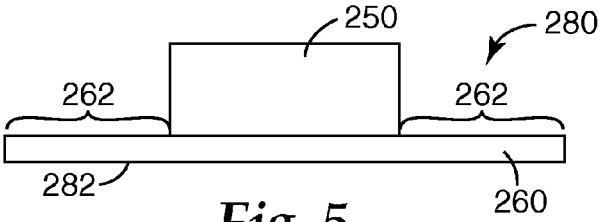
FIG. 5 is a side view of one exemplary unitary compressible article incorporating a compressible member and a support layer.
Figure 6:
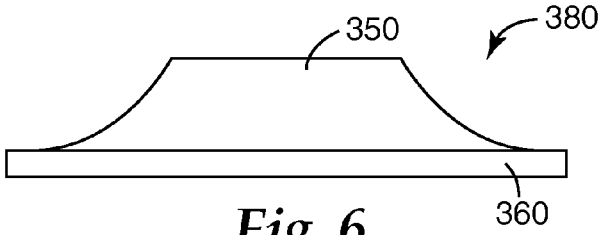
FIG. 6 is a side view of another exemplary unitary compressible article incorporating a compressible member and a support layer.

FIGS. 5-7 depict alternative embodiments in which one or more of the components are combined into unitary articles. FIG. 5 is a side view of a unitary compressible support article 280 in which the compressible member and support layer are combined. The unitary compressible support article 280 may preferably include a compressible member portion 250 and integrated support layer portion 260. It may be preferred that the support layer portion 260 form an annular ring 262 surrounding the compressible member 250. At least the annular ring 262 of the support layer 260 may preferably be thinner than the compressible member portion 250 such that the annular ring 262 of the support layer portion provides less support outside of the compressible member portion 250.

An abrasive member (not shown) may preferably be attached to the surface 282 of the compressible support article 280 (although in some instances, an abrasive layer may be formed directly on the surface 282 as is discussed herein). The compressible support article 280 may be formed as a single, homogenous mass of material (e.g., a single type of foam, etc.) or it may include different materials that are combined into a unitary article (e.g., insert molded, etc.).

FIG. 6 depicts another embodiment of a unitary compressible support article 380 in which the transition between the support member portion 350 and the support layer portion 360 is more gradual than that depicted in connection with the compressible support article 280 of FIG. 5.

Figure 7A:
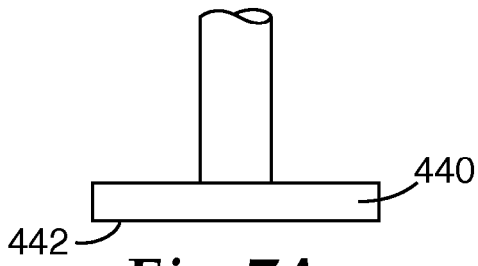
FIGS. 7A & 7B depict a base plate and the base plate embedded in a compressible member.
Figure 7B:
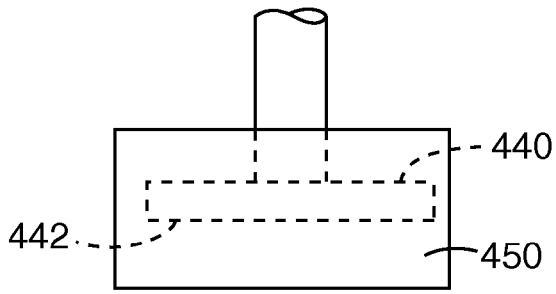

FIGS. 7A & 7B depict yet another variation in which a base plate 440 is located within the compressible member 450. In FIG. 7A, the base plate 440 is depicted separately, while FIG. 7B depicts the base plate 440 embedded in the compressible member 450. The compressible member 450 and embedded base plate 440 may be manufactured by any suitable process, e.g., insert molding, etc. In an embodiment such as that depicted in FIGS. 7A & 7B, only the portion of the compressible member 450 located on the side of the mounting surface 442 of the base plate 440 will act to support an abrasive surface. As such, although a portion of the compressible member 450 is attached to the back side of the base plate 440, the working portion of the compressible member 450 remains attached to the mounting surface 442 of the base plate 440 and preferably operates as described herein.

Furthermore, although the base plate 440 is depicted as being embedded in a compressible member 450, it should be understood that the base plate may alternatively be embedded in a unitary compressible support article, examples of which are depicted and described in connection with FIGS. 5 & 6 herein.

In addition to providing abrasive methods that involve rotational reciprocation along with abrasive articles, tools and kits for practicing the methods, the present invention also provides methods of repairing defects from a finished workpiece surface where the finished workpiece surface has a clear-coat, paint, varnish, etc. finish in which defects such as nibs, etc. are found. As discussed herein, it may be preferred that the defects be removed from the surface by abrading (sanding) the defect and the immediate area surrounding the defect with limited disturbance of any orange-peel (or other) texture found on the workpiece surface.

The sanding operation performed as a part of the repair methods of the invention preferably involves sanding one or more defects from a workpiece surface by rotationally reciprocating an abrasive surface of an abrasive article about an axis of rotation using the shaft of a driven tool as described herein. The workpiece surface is abraded by abrasive particles attached to the abrasive surface of the abrasive article while the abrasive surface of the abrasive article is rotationally reciprocating about the axis of rotation as described herein.

Figure 8:
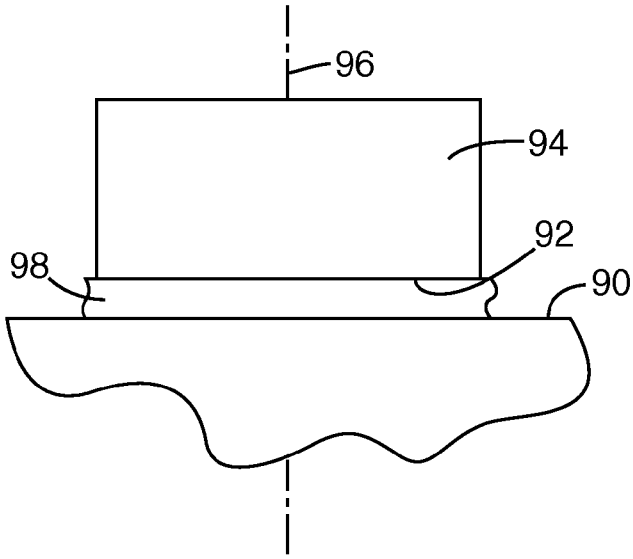
FIG. 8 depicts an exemplary polishing pad and a working surface that may be used in connection with the defect repair methods of the invention.

After the sanding of a defect is complete, the repair may further involve a polishing operation in which an area of the workpiece surface containing and surrounding the defect is worked to remove and/or reduce scratches formed during the sanding operation. As depicted in FIG. 8, the polishing operation may preferably be performed by contacting the workpiece surface 90 with the working surface 92 of a pad 94 while rotating the pad 94 about an axis of rotation 96 that extends through the workpiece surface 90 and working surface 92 of the pad 94. The pad 94 is rotated about at least one axis 96 in only one direction (in contrast to the rotational reciprocating motion used in connection with the abrasive surface).

It may be preferred that the pad 94 be attached to a dual action rotary tool such that the pad 94 moves in what is commonly referred to as a random orbital pattern. During operation of dual action rotary tool, the pad moves along a circular path disposed concentrically of or to orbit relative to a first axis about which the pad 94 is rotating, while the pad 94 is also free to rotate about a second axis that is typically parallel to but offset from the first axis. Examples of some potentially suitable dual action rotary tools may be described in, e.g., U.S. Pat. Nos. 2,794,303 and 4,854,085. Some potentially suitable dual action rotary tools are described in the examples described in connection with this invention.

The rotating pad 94 may or may not be moved across the workpiece surface 90 (in addition to the rotation about axis 96) as desired. The rotating pad 94 may preferably be forced against the workpiece surface 90 such that the working surface 92 of the pad 94 conforms to the shape of the workpiece surface 90.

The polishing also preferably includes the use of an abrasive slurry 98 located between the working surface 92 of the pad 94 and the workpiece surface 90 while rotating the working surface of the pad against the workpiece surface. The abrasive slurry 98 may be applied to the working surface of the pad, to the workpiece surface, or both the working surface of the pad and the workpiece surface. The abrasive slurry preferably contains abrasive particles in a liquid or paste-like carrier. The abrasive particles in the abrasive slurry are preferably finer than the abrasive particles used in the abrasive surface of the abrasive member used to perform the sanding operation. Such abrasive slurries are commonly used in surface finishing and may be described as rubbing compound, polishing compound, glazing compound, etc.

Figure 9:
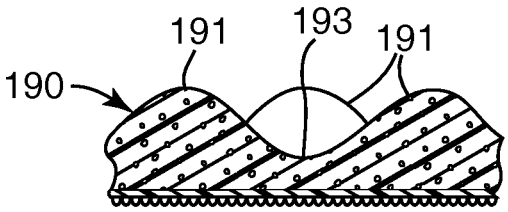
FIG. 9 is a partial cross-sectional view of one exemplary polishing pad having a convoluted working surface.

In a polishing operation of the present invention, a variety of materials may potentially be used for the working surfaces of the pads. Some potentially suitable materials for forming the working surfaces of the pads may include natural fibers, synthetic fibers, combinations thereof, and foams (see, e.g., U.S. Pat. Nos. 3,418,675; 4,962,562; 5,396,737; and 5,846,123). The pads may have working surfaces that are flat or that are convoluted (including projecting portions 191 and recessed portions 193 on a pad 190 as depicted in, e.g., FIG. 9). Examples of some potentially suitable convoluted pads with projecting and recessed portions may be described in, e.g., U.S. Pat. No. 5,396,737 and others.

The pads used for polishing in the methods of the present invention also preferably include resiliently compressible materials to assist with conformance of the working surface to the workpiece surface. The working surface itself may be constructed of resiliently compressible material and/or materials supporting the working surface may be resiliently compressible. Examples of some potentially suitable pads for use in the polishing methods of the invention may be identified in the Examples provided at the end of this document (before the claims).

Because the sanding operation may preferably be performed using smaller abrasive articles as described herein, the polishing operations may also be performed using pads with working surfaces that are also relatively small. For example, it may be preferred that the working surfaces of the pads have an area of about 2000 $mm^2$ or less, in some instances about 1000 $mm^2$ or less, and in some instances about 500 $mm^2$ or less.

While the rotational reciprocating motion of an abrasive article (even a smaller abrasive article as discussed herein) can provide enough abrasive energy to remove defects, the amount of abrasive energy is preferably small enough that the scratches formed are shallower and/or less material is removed from the workpiece surface (as compared to a process using a rotating sanding tool). The shallower scratches may preferably require less extensive refinishing as compared to more conventional sanding/refinishing methods.

In the surface repair methods of the present invention, the sanding of any area surrounding and containing one of the defects may preferably be followed by one or more subsequent polishing operations on the same area. If two or more polishing operations are performed after the sanding, it may be preferred that any abrasive particles used in the successive polishing operations be successively finer. In other words, it may be preferred that the abrasive particles in any subsequent polishing operation be finer than the abrasive particles in the abrasive slurry used in the preceding polishing operation.

In another variation, the working surfaces of the pads used in methods that include two or more polishing operations may be the same, i.e., the working surfaces may have the same shape and be manufactured of the same materials. Alternatively, the working surfaces of the pads used in two or more polishing operations may be different in one or more respects, i.e., the shape and/or materials used for the working surfaces may be different between the two polishing operations.

The following discussions provide additional descriptions of the various components that may be present in the abrasive articles used in connection with the present invention.

Base Plates: The base plate used in connection with the present invention preferably supplies a platform on which the remainder of the abrasive article is supported. It may be preferred that the base plate also include a structure that can couple with the shaft of a driven tool as discussed herein, although that coupling structure can be provided separate from the base plate.

The base plate preferably provides a rigid platform that does not significantly deform or deflect in response to the forces exerted on the base plate during normal use. It may be preferred that the base plate provide a flat mounting surface onto which the compressible member may be attached. The flat mounting surface may preferably be normal to the axis of rotation about which the base plate (and, thus, the abrasive article) reciprocates during use.

Examples of some potentially suitable materials from which the base plate may be manufactured can include, e.g., woods, metals, plastics, composites, etc.

Compressible Members: The optional compressible members used in connection with the present invention preferably support a central portion of the abrasive surface of the abrasive articles used in connection with the present invention. It is theorized that the resilient compressibility of the compressible member limits the concentration of forces applied by the abrasive surface at the edges of the base plate. It may also be preferred that in addition to resilient compressibility, the compressible member may also provide some torsional flex to the system, such that the compressible member may twist in response to changes in the rotational direction of the driven shaft of the tool.

The compressible member is preferably attached to a mounting surface of the base plate by any suitable technique or combination of techniques (e.g., hot melt adhesives, pressure sensitive adhesives, curable adhesives, glues, heat laminating, chemical welding, insert molding, etc.). Useful adhesives may include, for example, acrylic pressure sensitive adhesive, rubber-based pressure sensitive adhesives, water-borne lattices, solvent-based adhesives, and two-part resins (e.g., epoxies, polyesters, or polyurethanes). Examples of potentially suitable pressure sensitive adhesives may include those derived from acrylate polymers (for example, polybutyl acrylate) polyacrylate esters), acrylate copolymers (for example, isooctyl acrylate/acrylic acid), vinyl ethers (for example, polyvinyl n-butyl ether); alkyd adhesives; rubber adhesives (for example, natural rubbers, synthetic rubbers and chlorinated rubbers); and mixtures thereof. An example of one pressure sensitive adhesive coating is described in U.S. Pat. No. 5,520,957 (Bange et al.). These adhesives may also be used to attach various other components (e.g., support layer, abrasive member, etc.) in the abrasive article as well.

The material used to form the compressible member may include gas (e.g., air), liquid (e.g., water, oil), foam (e.g., as described herein), semi-solid gel or paste, combinations thereof, etc. In some instances, the compressible member may be in the form of a torsion spring. The compressible members may be manufactured as unitary articles (e.g., a single uniform layer of foam) or they may include one or more materials (e.g., a gel encased in an elastomeric bladder). It may be preferred, however, that the major surface of the compressible member that faces the abrasive member in the construction is flat (i.e., does not have the shape of a dome, curve, cone, truncated cone, ridges, polyhedron, truncated polyhedron, or other non-planar shapes (e.g., yurt-shaped surfaces).

In some embodiments, the compressible material may include an elastomer. For example, the compressible material may comprise, or even consist essentially of, at least one elastomeric gel or foamed elastomeric gel, typically comprising a highly plasticized elastomer. Examples of potentially useful elastomeric gels may include polyurethane elastomer gels, e.g., as described in U.S. Pat. No. 6,908,979 (Arendoski); SEEPS elastomer gels, e.g., as described in U.S. Pat. Nos. 5,994,450 and 6,797,765 (both to Pearce); styrene-butadiene-styrene/oil gels; and silicone elastomer gels, e.g., as described in U.S. Pat. No. 6,013,711 (Lewis et al.)

For solid and gel materials, the elastic modulus (measured at 1 Hz and 25° C.) for the compressible material may preferably be between about 1500 and about $4.9\times10^5$ Pascals (Pa), for example, between about 1750 and about $1\times10^5$ Pa, although this is not a requirement. Examples of such compressible materials may include styrene-butadiene-styrene/oil gels (e.g., having an elastic modulus of 1992 Pa at 1 Hz and 25° C.), urethane foam (e.g., having an elastic modulus of $3.02\times10^5$ Pa at 1 Hz and 25° C. or $4.31\times10^5$ Pa at 1 Hz and 25° C.); and elastomeric urethane rubber (e.g., having modulus $4.89\times10^5$ Pa at 1 Hz and 25° C.).

Typically, the thickness of the compressible member will be selected based on factors such as, for example, the intended use and the overall size of the abrasive article. Further, it may be preferred that the thickness of the compressible member be substantially uniform over its major surfaces. In some embodiments, the thickness of the compressible member may be, e.g., about 0.5 millimeters (mm) or more, in some instances 1 mm or more, or even 1.5 mm or more. At the upper end, the thickness of the compressible members may preferably be about 5 mm or less, preferably about 3 mm or less, or even about 2 mm or less. Compressible members with thicknesses outside of these ranges may also be used.

Support Layer: As discussed herein, the optional support layer is preferably a flexible, resilient layer that provides support to the abrasive member during use. The support layer may preferably be located between the compressible member and the abrasive member in the abrasive articles of the present invention. The support layer may be attached to the compressible member by any suitable technique or combination of techniques (e.g., hot melt adhesives, pressure sensitive adhesives, curable adhesives, glues, heat laminating, chemical welding, coextrusion, insert molding, etc.).

In addition to being flexible and resilient, it may be preferred that the support layer also be compressible such that it may compress in response to the forces exerted on the abrasive surface supported by the support layer during use.

In some embodiments the support layer may preferably be constructed of resilient compressible material, e.g., foams, etc. Some potentially useful compressible foams may include, for example, polyvinyl chloride foams, chloroprene rubber foams, ethylene/propylene rubber foams, butyl rubber foams, polybutadiene foams, polyisoprene foams, EPDM polymer foams, polyurethane foams, ethylene-vinyl acetate foams, neoprene foams, and styrene/butadiene copolymer foams.

The thickness of the support layer may be, e.g., about 0.01 mm or more, or even 0.1 mm or more. At the upper end, the support layer may have a thickness of about 2 mm or less, or even 1 mm or less. Support layers with thicknesses outside of these ranges may also be used.

Abrasive Members: The abrasive members used in the abrasive articles of the present invention provide the abrasive surface used to abrade workpieces. The abrasive members may preferably include an abrasive layer that is optionally affixed to a flexible backing (i.e., a coated abrasive article). The optional flexible backing of the abrasive member may be elastic or inelastic.

In some embodiments, it may be possible to use the support layer as a flexible backing for the abrasive member. In such embodiments, the abrasive layer may preferably be attached to the support layer as a part of the manufacturing process for the abrasive member. In other embodiments, the abrasive member is manufactured separately and then attached to the optional support layer.

The abrasive member may be attached to the support layer (or compressible member if no support layer is present) by any suitable technique or combination of techniques (e.g., hot melt adhesives, pressure sensitive adhesives, curable adhesives, glues, heat laminating, chemical welding, coextrusion, etc.).

Figure 10A:
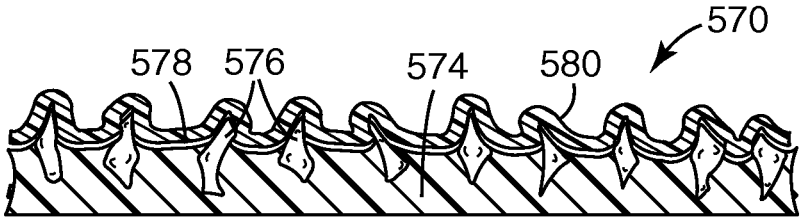
FIGS. 10A-10C are enlarged schematic cross-sectional views of various embodiments of abrasive layers that may be used in abrasive members of the present invention.

In some embodiments, the abrasive layers may include make and size layers and abrasive particles as shown, for example, in FIG. 10A where abrasive layer 570 includes make layer 574, abrasive particles 576, size layer 578, and optional supersize 580. Potentially useful make, size, and optional supersize layers, flexible coated abrasive articles, and methods of making the same may include, for example, those described in U.S. Pat. No. 4,588,419 (Caul et al.); U.S. Pat. No. 4,734,104 (Broberg); U.S. Pat. No. 4,737,163 (Larkey); U.S. Pat. No. 4,751,138 (Tumey et al.); U.S. Pat. No. 5,078,753 (Broberg et al.); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,366,523 (Rowenhorst et al.); U.S. Pat. No. 5,417,726 (Stout et al.); U.S. Pat. No. 5,436,063 (Follett et al.); U.S. Pat. No. 5,490,878 (Peterson et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Tumey et al.); U.S. Pat. No. 5,766,277 (DeVoe et al.); U.S. Pat. No. 6,059,850 (Lise et al.); U.S. Pat. No. 6,077,601 (DeVoe et al.); U.S. Pat. No. 6,228,133 (Thurber et al.); and U.S. Pat. No. 5,975,988 (Christianson); those marketed by 3M Company under the trade designations "260L IMPERIAL FINISHING FILM"; etc.

Figure 10B:
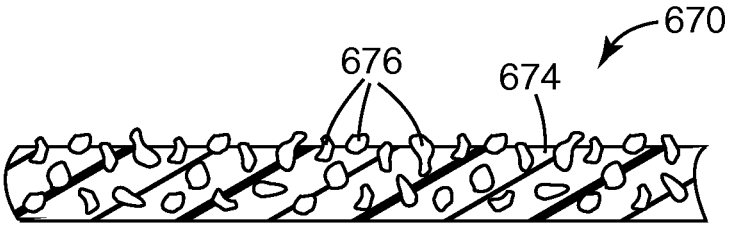

In other embodiments, the abrasive layer may include abrasive particles in a binder, typically substantially uniformly distributed throughout the binder, as shown, for example, in FIG. 10B where abrasive layer 670 includes binder 674 and abrasive particles 676. Details concerning materials and methods for making such potentially suitable abrasive layers may be found, for example, in U.S. Pat. No. 4,927,431 (Buchanan et al.); U.S. Pat. No. 5,014,468 (Ravipati et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.); and U.S. Pat. Appln. Publ. Nos. 2003/0207659 A1 (Annen et al.) and 2005/0020190 A1 (Schutz et al.); etc.

As discussed herein, in those embodiments where the abrasive member itself does not include a separate backing layer, it may be possible to apply a slurry of abrasive particles in a binder precursor directly to the support layer material described herein, and then at least partially cure the slurry to form the abrasive member on the support layer. Examples of potentially useful flexible coated abrasive articles of this embodiment may include those described in U.S. Pat. No. 6,929,539 (Schutz et al.).

Figure 10C:
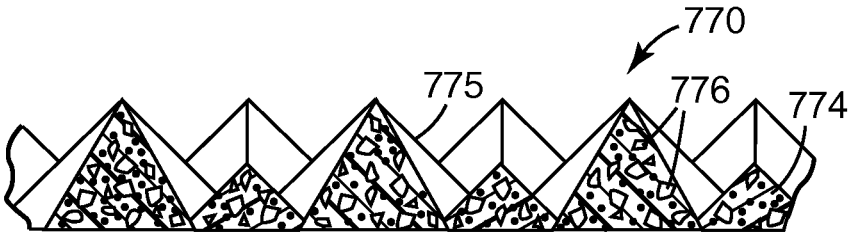

In some embodiments, the abrasive layer may be in the form of a structured abrasive layer, for example, as depicted in FIG. 10C where structured abrasive layer 770 includes abrasive composites 775 (where the term "abrasive composite" refers to a body that includes abrasive particles and a binder). The abrasive composites 775 include abrasive particles 776 dispersed throughout binder 774. In those embodiments where the abrasive member itself does not include a separate backing layer, it may be possible to form the structured abrasive layer 770 directly on the support layer material as described herein.

Structured abrasive layers that may be used in connection with the present invention may include abrasive composites in the form of a plurality of non-randomly shaped bodies. The abrasive composites 775 may preferably be arranged according to a predetermined pattern (e.g., as an array).

In some embodiments, at least a portion of the abrasive composites 775 may preferably be "precisely shaped" abrasive composites. This means that the shape of the abrasive composites is defined by relatively smooth surfaced sides that are bounded and joined by well-defined edges having distinct edge lengths with distinct endpoints defined by the intersections of the various sides. The terms "bounded" and "boundary" refer to the exposed surfaces and edges of each composite that delimit and define the actual three-dimensional shape of each abrasive composite. These boundaries are readily visible and discernible when a cross-section of an abrasive article is viewed under a scanning electron microscope. These boundaries separate and distinguish one precisely shaped abrasive composite from another even if the composites abut each other along a common border at their bases. By comparison, in an abrasive composite that does not have a precise shape, the boundaries and edges are not well defined (e.g., where the abrasive composite sags before completion of its curing). Typically, precisely shaped abrasive composites are arranged on the backing according to a predetermined pattern or array, although this is not a requirement.

Shaped abrasive composites may be arranged such that some of their work surfaces are recessed from the outermost surfaces of the abrasive layer.

Suitable optional flexible backings that may be used in connection with abrasive members may include flexible backings used in the abrasive art such as, for example, flexible polymeric films (including primed polymeric films and elastomeric polymeric films), elastomeric cloth, polymeric foam (e.g., polyvinyl chloride foam, polyurethane foam, etc.), and combinations thereof. Examples of suitable flexible polymeric films include polyester films, polypropylene films, polyethylene films, ionomer films (e.g., those available under the trade designation "SURLYN" from E.I. du Pont de Nemours & Co., Wilmington, Del.), vinyl films, polycarbonate films, and laminates thereof.

Structured abrasive composites may be prepared by forming a slurry of abrasive particles and a solidifiable or polymerizable precursor of the abovementioned binder resin (i.e., a binder precursor), contacting the slurry with a backing member (or directly with the support layer), and solidifying and/or polymerizing the binder precursor (e.g., by exposure to electromagnetic radiation or thermal energy) in a manner such that the resulting structured abrasive article has a plurality of shaped abrasive composites affixed to the backing member.

Examples of some potentially suitable energy sources may include, e.g., thermal energy and radiant energy (including electron beam, ultraviolet light, and visible light).

In some embodiments the slurry may be coated directly onto a production tool having precisely shaped cavities therein and brought into contact with the backing, or coated on the backing and brought to contact with the production tool. In such an embodiment, the slurry is typically then solidified or cured while it is present in the cavities of the production tool. U.S. Pat. No. 6,929,539 (Schutz et al.) discloses some potentially suitable procedures to accomplish this process.

Precisely-shaped abrasive composites may be of any three-dimensional shape that results in at least one of a raised feature or recess on the exposed surface of the abrasive layer. Useful shapes may include, for example, cubic, prismatic, pyramidal (e.g., square pyramidal or hexagonal pyramidal), truncated pyramidal, conical, frusto-conical, pup-tent shaped, ridge shaped, etc. Combinations of differently shaped and/or sized abrasive composites may also be used in the same abrasive member. The abrasive layer of the structured abrasive member may be continuous or discontinuous.

For fine finishing applications, the density of shaped abrasive composites on the abrasive surface may typically be in a range of from at least about 1,000, about 10,000, or even at least about 20,000 abrasive composites per square inch (e.g., at least about 150, about 1,500, or even about 7,800 abrasive composites per square centimeter) up to and including about 50,000, about 70,000, or even as many as about 100,000 abrasive composites per square inch (up to and including about 7,800, about 11,000, or even as many as about 15,000 abrasive composites per square centimeter), although greater or lesser densities of abrasive composites may also be used.

Further details concerning structured abrasive layers having precisely shaped abrasive composites, and methods for their manufacture may be found, for example, in U.S. Pat. No. 5,152,917 (Pieper et al.); U.S. Pat. No. 5,304,223 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,549,962 (Holmes et al.); U.S. Pat. No. 5,700,302 (Stoetzel et al.); U.S. Pat. No. 5,851,247 (Stoetzel et al.); U.S. Pat. No. 5,910,471 (Christianson et al.); U.S. Pat. No. 5,913,716 (Mucci et al.); U.S. Pat. No. 5,958,794 (Bruxvoort et al.); U.S. Pat. No. 6,139,594 (Kincaid et al.); U.S. Pat. No. 6,923,840 (Schutz et al.); and U.S. Pat. Appln. Nos. 2003/0022604 (Annen et al.).

Some structured abrasive members having precisely shaped abrasive composites that may be useful for practicing the present invention are commercially available as films and/or discs, for example, as marketed under the trade designation "3M TRIZACT FINESSE-IT" by 3M Company, Saint Paul, Minn. Examples include "3M FINESSE-IT TRIZACT FILM, 466LA" available in grades A7, A5 and A3. Structured abrasive members having larger abrasive composite sizes may also be useful for practicing the present invention, for example, those marketed under the trade designation "TRIZACT CF", available from 3M Company.

Structured abrasive members may also be prepared by coating a slurry comprising a polymerizable binder precursor, abrasive particles, and an optional silane coupling agent through a screen that is in contact with a backing. In this embodiment, the slurry is typically then further polymerized (e.g., by exposure to an energy source) while it is present in the openings of the screen thereby forming a plurality of shaped abrasive composites generally corresponding in shape to the screen openings. Further details concerning this type of screen coated structured abrasive may be found, for example, in U.S. Pat. No. 4,927,431 (Buchanan et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.).

In some embodiments, a slurry comprising a polymerizable binder precursor, abrasive particles, and an optional silane coupling agent may be deposited on a backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing Embossed structured abrasive members prepared by this and related methods are described, for example, in U.S. Patent Application Publication No. 2001/0041511 (Lack et al.). Commercially available examples of such embossed structured abrasive members are believed to include abrasive belts and discs available from Norton-St. Gobain Abrasives Company, Worcester, Mass., under the trade designation "NORAX" such as for example, "NORAX U264-X80", "NORAX U266-X30", "NORAX U264-X80", "NORAX U264-X45", "NORAX U254-X45, X30", "NORAX U264-X16", "NORAX U336-X5" and "NORAX U254-AF06".

Structured abrasive layers may also be prepared by coating a slurry comprising a polymerizable binder precursor, abrasive particles, and an optional silane coupling agent through a screen that is in contact with the elastic member, which may optionally have a tie layer or surface treatment thereon. In this embodiment, the slurry is typically then further polymerized (e.g., by exposure to an energy source such as heat or electromagnetic radiation) while it is present in the openings of the screen thereby forming a plurality of shaped abrasive composites generally corresponding in shape to the screen openings. Further details concerning this type of screen coated structured abrasive may be found, for example, in U.S. Pat. No. 4,927,431 (Buchanan et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.); and in U.S. Publ. Pat. Appl. No. 2001/0041511 (Lack et al.).

Useful polymerizable binder precursors that may be cured to form the above-mentioned binders are well-known and include, for example, thermally curable resins and radiation curable resins, which may be cured, for example, thermally and/or by exposure to radiation energy. Exemplary polymerizable binder precursors include phenolic resins, aminoplast resins, urea-formaldehyde resins, melamine-formaldehyde resins, urethane resins, polyacrylates (e.g., an aminoplast resin having pendant free-radically polymerizable unsaturated groups, urethane acrylates, acrylate isocyanurate, (poly) acrylate monomers, and acrylic resins), alkyd resins, epoxy resins (including bis-maleimide and fluorene-modified epoxy resins), isocyanurate resins, allyl resins, furan resins, cyanate esters, polyimides, and mixtures thereof. Polymerizable binder precursors may contain one or more reactive diluents (e.g., low viscosity monoacrylates) and/or adhesion promoting monomers (e.g., acrylic acid or methacrylic acid).

If either ultraviolet radiation or visible radiation is to be used, the polymerizable binder precursor typically further comprise a photoinitiator. Examples of photoinitiators that generate a free radical source include, but are not limited to, organic peroxides, azo compounds, quinones, benzophenones, nitroso compounds, acyl halides, hydrazones, mercapto compounds, pyrylium compounds, triacrylimidazoles, bisimidazoles, phosphene oxides, chloroalkyltriazines, benzoin ethers, benzil ketals, thioxanthones, acetophenone derivatives, and combinations thereof.

Cationic photoinitiators generate an acid source to initiate the polymerization of an epoxy resin. Cationic photoinitiators can include a salt having an onium cation and a halogen containing a complex anion of a metal or metalloid. Other cationic photoinitiators include a salt having an organometallic complex cation and a halogen containing complex anion of a metal or metalloid. These are further described in U.S. Pat. No. 4,751,138. Another example of a cationic photoinitiator is an organometallic salt and an onium salt described in U.S. Pat. No. 4,985,340; European Patent Publication Nos. EP 306,161 and EP 306,162. Still other cationic photoinitiators include an ionic salt of an organometallic complex in which the metal is selected from the elements of Periodic Groups IVB, VB, VIIB, VIIB and VIIIB.

The polymerizable binder precursor may also include resins that are curable by sources of energy other than radiation energy, such as condensation curable resins. Examples of such condensation curable resins include phenolic resins, melamine-formaldehyde resins, and urea-formaldehyde resins.

The binder precursor and binder may include one or more optional additives selected from the group consisting of grinding aids, fillers, wetting agents, chemical blowing agents, surfactants, pigments, coupling agents, dyes, initiators, energy receptors, and mixtures thereof. The optional additives may also be selected from the group consisting of potassium fluoroborate, lithium stearate, glass bubbles, inflatable bubbles, glass beads, cryolite, polyurethane particles, polysiloxane gum, polymeric particles, solid waxes, liquid waxes and mixtures thereof.

Abrasive particles useful in the present invention can generally be divided into two classes: natural abrasives and manufactured abrasives. Examples of useful natural abrasives include: diamond, corundum, emery, garnet (off-red color), buhrstone, chert, quartz, garnet, emery, sandstone, chalcedony, flint, quartzite, silica, feldspar, natural crushed aluminum oxide, pumice and talc. Examples of manufactured abrasives include: boron carbide, cubic boron nitride, fused alumina, ceramic aluminum oxide, heat treated aluminum oxide (both brown and dark grey), fused alumina zirconia, glass, glass ceramics, silicon carbide, iron oxides, tantalum carbide, chromia, cerium oxide, tin oxide, titanium carbide, titanium diboride, synthetic diamond, manganese dioxide, zirconium oxide, sol gel alumina-based ceramics, silicon nitride, and agglomerates thereof. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.).

The size of an abrasive particle is typically specified to be the longest dimension of the abrasive particle. In most cases there will be a range distribution of particle sizes. The particle size distribution may be tightly controlled such that the resulting abrasive article provides a consistent surface finish on the workpiece being abraded, however, broad and/or polymodal particle size distributions may also be used.

The abrasive particle may also have a shape associated with it. Examples of such shapes include rods, triangles, pyramids, cones, solid spheres, hollow spheres and the like. Alternatively, the abrasive particle may be randomly shaped.

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the adhesion of the abrasive particles in the softened particulate curable binder material. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.).

In some embodiments, for example, those including shaped abrasive composites, the abrasive particles used in the abrasive members of the present invention may preferably have a particle size of about 0.1 micrometer (μm) or more. At the upper end of the range, the abrasive particles may have a particle size of about 450 μm or less, or even 100 μm or less. In some embodiments, the abrasive particles may have a size within a range of from JIS grade 800 (14 μm at 50% midpoint) or higher, or even JIS grade 1000 (12 μm at 50% midpoint). At the opposite end of the range, the abrasive particles have a size of JIS grade 6000 (2 μm at 50% midpoint) or lower, in some instances JIS grade 4000 (3 μm at 50% midpoint) or lower, or even JIS grade 2000 (5-8 μm at 50% midpoint) or lower.

Typically, the abrasive particles used in the present invention have a Moh's hardness of at least 8, more typically above 9; however, abrasive particles having a Moh's hardness of less than 8 may be used.

Aspects of this invention may be further illustrated by the following non-limiting examples, but the particular materials and amounts thereof recited in these examples, as well as other conditions and, details, should not be construed to unduly limit this invention.

SANDING EXAMPLES

The following descriptions demonstrate exemplary use of the abrasive articles, tools and methods of the present invention and comparative abrasive articles, tools and methods.

Rotationally Reciprocating Tool: The rotationally-reciprocating driven tool used in Examples 1-4 was manufactured as follows. The plastic shell from the brushhead of a battery-powered toothbrush, Model "Oral B AdvancePower 450TX" (Braun GmbH, Kronberg, Germany) was removed. The exposed brushhead connector was cut to a length of approximately 1 inch (2.54 cm), and the end sanded to form a smooth distal face perpendicular to the length of the drive shaft of the toothbrush. A 0.25 inch (0.64 cm) diameter, 0.033 inch (0.84 mm) thick hard plastic disc was then cemented to the distal face using a 2-part epoxy resin and hardener (commercially available under the trade designation "Quick Weld Compound" from Dynatex, Elizabethtown, Ky.) to form a removable base plate assembly with a 0.25 inch diameter mounting surface oriented perpendicular to the rotationally reciprocating shaft of the tool. The tool was powered by two 3-volt AA-sized lithium batteries, "Part # U-3191" obtained from Apex Battery, Anaheim Hills, Calif.

Conventional Rotary Tool: The conventional sanding tool used in the examples was a pneumatically driven dual action sander, Model Number 57500 (Dynabrade, Inc., Clarence, N.Y.) in combination with a 1.25-inch (3.2 cm) back-up pad (commercially available under the trade designation FINESSE-IT ROLOC Sanding Pad, Part No. 02345 from 3M, St. Paul, Minn.) to support the abrasive discs attached to the conventional sanding tool as discussed in connection with the comparative examples.

Structured Abrasive Members: Structured abrasive members used in connection with the examples and sanding tests described herein were manufactured using the following materials (identified below by the abbreviations appearing at the beginning of each of the following descriptions):

AS1: trimethylolpropane triacrylate monomer having a molecular weight of 296 and functionality of 3, available under the trade designation "SR 351" from Sartomer Company, Exton, Pa.;

AS2: 2-phenoxyethyl acrylate aromatic monomer having a molecular weight of 192 and functionality of 1 available under the trade designation "SR 339" from Sartomer Company;

AS3: a polymeric disperant available under the trade designation "Solplus D520" from Noveon, Inc., Cleveland, Ohio;

AS4: gamma-methacryloxypropyltrimethoxy silane resin modifier available under the trade designation "Silquest A174" from Witco Corporation, Greenwich, Conn.;

AS5: ethyl 2,4,6-trimethylbenzoylphenylphosphinate photoinitiator available under the trade designation "Lucirin TPO-L" from BASF Corp., Charlotte, N.C.; and AS6: green silicon carbide abrasive particles having a JIS grade size of 1500 and an average particle size of 8.0 micrometers (μm) at 50% point, available under the trade designation "Fujimi GC 1500" from Fujimi Abrasives Company, Elmhurst, Ill.

An abrasive slurry was made at 20 degrees Centigrade (° C.) by mixing the listed components in parts by weight until homogeneous: 12.9 parts of AS1, 19.5 parts of AS2, 3.1 parts of AS3, 1.9 parts of AS4, 1.1 parts of AS5 and 61.5 parts of AS6. The slurry was applied by knife coating to a polypropylene abrasive production tool made according to the methods described in U.S. Pat. No. 6,846,232 (Braunschweig et al.). The dimensions of the abrasive production tool used in Examples 1-4 below are described in Example 2 of U.S. Pat. No. 6,846,232.

The coated production tool was applied to the primed face of 0.003 inch (76 micrometer (μm)) polyester film available under the trade designation SCOTCHPAK polyester film from 3M Company, St. Paul, Minn. The production tool was then irradiated with an ultraviolet (UV) lamp, type "D" bulb, from Fusion Systems Inc., Gaithersburg, Md., at 600 Watts per inch (236 Watts per centimeter (W/cm)) while moving the web at 30 feet per minute (9.14 meters/minute), at a nip pressure of 90 pounds per square inch (620.5 kilopascals (kPa)) for a 10 inch (25.4 cm) wide web, and mandrel temperature of 60° C. The web with the structured abrasive layer formed thereon was separated from the production tool and die-cut into 0.5 inch (1.27 cm) diameter disc-structured abrasive members.

Example 1

An abrasive article was manufactured using transfer adhesive (commercially available under the trade designation "9453LE" from 3M Company) that was applied to the non-abrasive face of a 0.5 inch (1.27 cm) diameter structured abrasive member (manufactured as described above). The larger 0.5 inch diameter abrasive member was centered over and attached to the smaller 0.25 inch diameter mounting surface of the base plate assembly. The abrasive article of Example 1 thus included the following components depicted in FIG. 4: the base plate 140 and abrasive member 170 attached directly to the base plate 140. The abrasive article was then used as described in Sanding Test No. 1 below.

Example 2

An abrasive article was manufactured by die-cutting a 0.5 inch (1.27 cm) diameter polyvinyl foam disc, 0.027 inch (0.69 mm) thick from an adhesive bandage commercially available under the trade designation NEXCARE ADHESIVE STRIP BANDAGE from 3M Company. The adhesive liner was removed and the adhesive face of the foam disc was attached to the non-abrasive major surface of a 0.5 inch diameter structured abrasive member (manufactured as described above). The transfer adhesive of Example 1 was then applied to the non-adhesive face of the foam disc. The transfer adhesive-coated major surface of the larger 0.5 inch diameter polyvinyl foam disc (with its attached structured abrasive member) was then centered over and attached to the smaller 0.25 inch diameter mounting surface of the base plate assembly. The abrasive article of Example 2 thus included the following components depicted in FIG. 4: the base plate 140, support layer 160 (polyvinyl foam disc), and abrasive member 170. The support layer 160 was attached directly to the base plate 140. The abrasive article was then used as described in Sanding Test No. 1 below.

Example 3

An abrasive article was made according to the method described in Example 2, except that the 0.5 inch (1.27 cm) diameter polyvinyl foam was replaced by a 5/16 inch (7.9 mm), 0.090 inch (2.29 mm) thick disc of polyurethane foam, commercially available under the trade designation "R600U-090" from Illbruck Company, Minneapolis, Minn. The larger 0.5 inch diameter structured abrasive member was centered over the smaller 5/16 inch diameter polyurethane foam disc. The 5/16 inch diameter polyurethane foam disc was centered on the 0.25 inch diameter mounting surface of the base plate assembly. The abrasive article of Example 3 thus included the following components depicted in FIG. 4: the base plate 140, compressible member 150 (polyurethane foam disc), and abrasive member 170. The abrasive member 170 was attached directly to the compressible member 150. The abrasive article was then used as described in Sanding Test No. 1 below.

Example 4

An abrasive article was manufactured that included all of the components depicted in FIG. 4, i.e., the base plate 140 (as described in connection with the rotationally reciprocating tool above), the compressible member 150 (the polyurethane foam disc described in connection with Example 3), the support layer 160 (the polyvinyl foam disc described in connection with Example 2), and the abrasive member 170 (a structured abrasive member as described above). Except for the adhesive already located on one side of the polyvinyl foam disc, the transfer adhesive identified in Example 1 was used to attach the components to each other. The smaller diameter components (the base plate 140 and polyurethane foam compressible member 150) were centered on each and the larger components (the polyvinyl foam support layer 160 and the structured abrasive member 170) were centered on the compressible member. The abrasive article was then used as described in Sanding Test No. 1 below.

Comparative Example A

An abrasive article in the form of a 1.25-inch (3.2 cm) diameter, grade JIS 3000, abrasive disc (commercially available under the trade designation "466LA A5, Part No. 56251" from 3M Company) was mounted on the conventional sanding tool described above. The abrasive article was then used as described in Sanding Test No. 2 below.

Comparative Example B

An abrasive article was formed using an abrasive sheet commercially available under the trade designation "401Q WETORDRY Grade 2000" from 3M Company that was folded to a suitable shape for use in the manual Sanding Test No. 3 below.

Test Measurements: A clear-coated, black-painted, cold rolled steel test panel having an orange-peel texture, 18 by 24 inches (45.7 cm by 61 cm), part number "APR45077" was obtained from ACT Laboratories, Inc., Hillsdale, Mich.

Orange Peel: The level of "orange peel" finish on the test panel was measured using a surface texture analyzer, model "WaveScan DOI", obtained from BYK-Gardner USA, Columbia, Md. Wavescan values reported below represent an average of 3 scans, each 5 cm in length, of different areas of the sanded test area, measured after polishing. It is theorized that departure from the control (non-sanded) panel values, in particular $W_c$ and $W_d$, reflect changes in orange peel due to the sanding process.

Surface Finish: The surface finish ($R_z$—the maximum vertical distance between the highest and lowest point of a test area) was measured after the sanding step using a profilometer, model "SURTRONIC 3+PROFILOMETER" obtained Taylor Hobson, Inc., Leicester, England. The $R_z$ values, reported below represent the average of 5 individual measurements of a 2 centimeter by 6 centimeter sanded area.

Gouging: Gouging was a subjective assessment of the level of macro surface irregularities caused by excessive canting (i.e., off-angle, non-planar, etc.) during the sanding process. Gouging values are reported on a subjective scale of zero (0) to five (5), where zero (0) represents no irregularities.

Sanding Test No. 1: The abrasive articles of Examples 1-4 were used on the rotationally reciprocating tool to sand an area of the test panel. For each different abrasive article the tool was switched on and, with minimal lateral movement and a sanding angle of zero degrees (i.e., the flat abrasive surface was held parallel to the workpiece surface), a previously identified defect in the form of a protrusion in the test panel was sanded until removed to establish a baseline sanding time of 7 seconds. The abrasive article on the tool was replaced and a fresh area of the test panel sanded for the same amount of time. The abrasive article was replaced and an adjacent area was then sanded for 7 seconds. This process was repeated until the matte or sanded area on the test panel was 2 cm by 6 cm, after which the area was outlined using a permanent marker for subsequent identification after polishing.

Each sanded area was then polished for 6 seconds at 1400 rpm using the following configuration: Polisher: Dewalt electric buffer, model number "DW849" obtained from Dewalt Industrial Tool Corp., Hampstead, Md.; Backup Pad: "Perfect-it Backup Pad #05718"; Polishing Pad: "Perfect-it Foam Polishing Pad #05725"; and Finisher: "Perfect-it 3000 Trizact Spot Finishing Material #06070", all available from 3M Company.

Comparative Sanding Test No. 2: The abrasive member of Comparative Example A was attached to the backup pad of conventional sanding tool described and the pneumatic line pressure attached to the tool was set at 90 pounds per square inch (psi) (620.5 kiloPascals (kPa)). With minimal lateral movement and a sanding angle of zero degrees, a previously identified protrusion in the test panel was sanded until removed, thereby establishing a baseline sanding time of 3 seconds. The abrasive disc was replaced with another sample and an adjacent area was then sanded for 3 seconds. This process was repeated once more until the matte area was approximately 3 cm by 9 cm, after which the area was outlined using a permanent marker. Each sanded area was then polished according to the method described in Sanding Test No. 1.

Sanding Test No. 3: By applying light finger pressure, and with minimal lateral movement, the test panel was manually sanded using unidirectional strokes for 3 seconds with the abrasive article described in Comparative Example B. The abrasive article was replaced and an adjacent area sanded. This was repeated until the sanded area was approximately 2 by 6 cm.

Table 1 presents the results of the sanding tests discussed above:

TABLE 1

| Abrasive Sample | Sanding Test | Gouging | Wa | Wb | Wc | Wd | We | Rz (μm) |
|---|---|---|---|---|---|---|---|---|
| Control Panel | N/A | N/A | 4.7 | 16.5 | 13.4 | 16.7 | 12.5 | N/A |
| Example 1 | 1 | 5 | 11.7 | 24.7 | 21.3 | 28.2 | 19.9 | 0.81 |
| Example 2 | 1 | 3 | 3.3 | 8.1 | 7.1 | 17.4 | 12.8 | 0.71 |
| Example 3 | 1 | 2 | 4.0 | 9.0 | 6.4 | 16.1 | 20.6 | 0.33 |
| Example 4 | 1 | 0 | 5.4 | 17.6 | 10.3 | 13.8 | 10.3 | 0.33 |
| Comparative A | 2 | 0 | 5.7 | 10.3 | 2.9 | 5.0 | 11.9 | 0.48 |
| Comparative B | 3 | 3 | 4.4 | 24.3 | 24.9 | 24.5 | 13.3 | 1.47 |

N/A = Not applicable

Defect Repair Examples

The following descriptions demonstrate exemplary methods of defect removal and polishing using the abrasive articles, tools and methods of the present invention as well as a comparative conventional method.

Test Panel: A steel automobile hood with a black painted finish was prepared by spray painting a clear-coat over the black painted finish. The clear-coat finish was commercially available under the trade designation AUTOCLEAR III from Akzo Noble, Narcross, Ga., and curing for 40 minutes at 140° F. (60° C.).

Comparative Example C

The following conventional five-step repair process was performed on the twelve (12) defects on a test panel. The test panel was cleaned between steps by wiping off residual abrasive slurry using a detail cloth (obtained under the trade designation PERFECT-IT detail cloth, Part No. 06020 from 3M Company. A fresh detailing cloth was used for the final polishing step.

Step 1 (Defect Removal): An abrasive article formed as described in Comparative Example B was used by applying light finger pressure, and with minimal lateral movement, to remove twelve (12) paint defects (nibs) in the surface of the test panel described above. Sanding time to remove all of the defects was 3 minutes.

Step 2 (Scratch Refinement): A 6-inch (15.2 cm) diameter backup pad, commercially available under the trade designation HOOKIT II disk pad (Part Number 05251 from 3M Company) was attached to a dual action sander, Model Number 21035 (Dynabrade, Inc., Clarence, N.Y.). A 6-inch (15.2 cm) diameter interface pad, trade designation HOOKIT II SOFT interface pad (Part Number 05274 from 3M Company) was attached to the backup pad. A 6-inch (15.2 cm) diameter foam pad, trade designation TRIZACT HOOKIT II foam disc (Part Number 02075, Grade P-3000, also from 3M Company) was then attached to the interface pad. The scratches formed during the defect removal of Step 1 were refined by applying pressure to the areas containing the scratches using the foam pad while operating the dual action sander at a line pressure set at 60 pounds per square inch (psi) (413.7 kiloPascals (kPa)) with the pad held generally parallel to the surface of the test panel. Scratch refinement time to refine the scratches in each of the sanded areas was 3 minutes 30 seconds.

Step 3 (Compounding): An 8-inch (20.3 cm) backup pad, commercially available under the trade designation PERFECT-IT backup pad (Part Number 05718 from 3M Company), was attached to an 8-inch (20.3 cm) buffing tool, Model Number DW 849 from Dewalt Industrial Tool Corporation, Hampstead, Md. A 9-inch (22.9 cm) wool pad, commercially available under the trade designation PERFECT-IT III compounding pad (Part Number 05719 from 3M Company) was attached to the backup pad. An abrasive slurry commonly referred to as rubbing compound (commercially available as PERFECT-IT 3000 EXTRA CUT rubbing compound from 3M Company) was applied to the sanded and refined areas of the test panel and buffed for 8 minutes using the wool pad while operating the buffing tool at 1,800 revolutions per minute (rpm).

Step 4 (Polishing): Step 3 was repeated except that the wool pad was replaced by an 8-inch (20.3 cm) foam polishing pad (commercially available under the trade designation PERFECT-IT foam polishing pad, Part Number 05725 from 3M Company) and the abrasive slurry (rubbing compound) used in Step 3 was replaced with a second abrasive slurry including finer abrasive particles (PERFECT-IT 3000 swirl mark remover, Part Number 06064 also from 3M Company). The polishing step was performed for a total of six (6) minutes.

Step 5 (Swirl Elimination): Step 4 was repeated except that the swirl mark remover of Step 4 was replaced with a third abrasive slurry including still finer abrasive particles (commercially available as PERFECT-IT 3000 ULTRAFINA SE polish, Part Number 06068, available from 3M Company). The foam polishing pad used in Step 4 was also replaced with a different foam polishing pad (commercially available as PERFECT-IT ULTRAFINA foam polishing pad, Part Number 05733, from 3M Company). The swirl elimination step was performed for a total of four (4) minutes.

Example 5

Twelve (12) defects in the clear-coated surface of a test panel were repaired using exemplary abrasive articles and methods of the invention in a three (3) step process as described herein. The test panel was cleaned between steps as described in connection with Comparative Example C.

Step 1 (Defect Removal): An abrasive article as described in Example 4 was used on the rotationally reciprocating tool described above. For each defect to be removed, the tool was used to sand the defect with minimal lateral movement and a sanding angle of zero degrees (i.e., the abrasive surface was held parallel to the surface of the test panel). The tool and abrasive article were used to remove twelve (12) defects (paint nibs) in the test panel surface. Sanding time to remove the twelve defects was 2.5 minutes.

Step 2 (Compounding): A 1-inch (2.54 cm) adapter (commercially available under the trade designation ROLOC holder, Part Number 07500 from 3M Company) was attached to an 18-volt cordless drill, Model Number BTD140 from Makita Corp., La Mirada, Calif. A 1.25-inch (3.2 cm) diameter backup pad (commercially available under the trade designation FINESSE-IT ROLOC disc pad, Type J, Part Number 67415 from 3M Company) was attached to the adaptor. A 1.25-inch (3.2 cm) foam pad (die cut from a larger PERFECT-IT foam polishing pad, Part Number 05725 from 3M Company) was attached to the backup pad. An abrasive slurry (commercially available as PERFECT IT 3000 swirl mark remover, Part Number 06064 also from 3M Company) was applied to the sanded areas and buffed at approximately 1,500 rpm using the polishing pad. The compounding step was performed for a total of three (3) minutes.

Step 3 (Swirl Elimination): The polishing pad used in Step 2 was replaced with 1-inch diameter (2.54 cm) buffing pad (die-cut from a larger pad PERFECT-IT ULTRAFINA foam polishing pad, Part Number 05733 from 3M Company) and the abrasive slurry used in Step 2 was replaced with a second abrasive slurry containing finer abrasive particles (commercially available as PERFECT-IT 3000 ULTRAFINA SE polish, Part Number 06068, available from 3M Company). The swirl elimination step was performed by rotating the buffing pad at 1800 rpm for a total of 3 minutes.

Example 6

Twelve (12) defects in the clear-coated surface of a test panel were repaired using exemplary abrasive articles and methods of the invention in a three (3) step process as described herein. The test panel was cleaned between steps as described in connection with Comparative Example C.

Step 1 (Defect Removal): Step 1 of Example 5 was performed as described in Example 5, except that the defect removal step was performed for a total of 2 minutes 20 seconds.

Step 2 (Compounding): Step 2 of Example 5 was performed as described in Example 5, except that the compounding step was performed for a total of 3 minutes 10 seconds.

Step 3 (Swirl Elimination): Step 5 of Comparative Example C was performed for a total of 2 minutes and 20 seconds.

Example 7

Twelve (12) defects in the clear-coated surface of a test panel were repaired using exemplary abrasive articles and methods of the invention in a three (3) step process as described herein. The test panel was cleaned between steps as described in connection with Comparative Example C.

Step 1 (Defect Removal): Step 1 of Example 5 was performed as described in Example 5, except that the defect removal step was performed for a total of 2 minutes 30 seconds.

Step 2 (Compounding): Step 2 of Example 5 was performed as described in Example 5, except that the drill was replaced by a dual action sander (Model Number 57502 from Dynabrade Company) operated at a line pressure set at 90 psi (620 kPa). The compounding step was performed for a total of 3 minutes 15 seconds.

Step 3 (Swirl Elimination): Step 5 of Comparative Example C was performed, except that the dual action sander of Step 2 in this example was used in place of the buffing tool used in Step 5 of Comparative Example C. The dual action sander was operated at a line pressure set at 90 psi (620 kPa). In addition, a 1 inch (2.54 cm) foam polishing pad was die cut from a larger polishing pad (commercially available as PERFECT-IT ULTRAFINA foam polishing pad, Part Number 05733, from 3M Company). The swirl elimination step was performed for a total of three (3) minutes.

Example 8

Twelve (12) defects in the clear-coated surface of a test panel were repaired using exemplary abrasive articles and methods of the invention in a three (3) step process as described herein. The test panel was cleaned between steps as described in connection with Comparative Example C.

Step 1 (Defect Removal): Step 1 as described in Example 5 was repeated except that the time taken was 2 minutes 30 seconds.

Step 2 (Compounding): Step 2 as described in Example 7 was repeated, except that the time taken was 3 minutes 5 seconds.

Step 3 (Swirl Elimination): Step 3 as described in Example 6 was repeated, except that the time taken was 2 minutes 10 seconds.

Results of Comparative Example C and Examples 5-8

At the end of each of Comparative Example C and Examples 5-8, the finish of the test panel was visually rated according to the following scale:

1: Sand scratches still visible under shop lighting or direct sunlight conditions.
2: Deep swirls or haze visible under shop lighting or direct sunlight conditions.
3: Swirls or haze visible under only direct sunlight conditions.
4: Slight/Fine swirls or haze visible under only direct sunlight conditions.
5: No swirls or haze visible under shop lighting or direct sunlight conditions.

Panel finish ratings and the total time for all finish steps are listed in Table 2 below.

TABLE 2

| Sample | Time | Finish Rating |
|---|---|---|
| Comparative A | 24 minutes 30 seconds | 5 |
| Example 5 | 8 minutes 30 seconds | 3 |
| Example 6 | 7 minutes 50 seconds | 5 |
| Example 7 | 8 minutes 45 seconds | 3 |
| Example 8 | 7 minutes 45 seconds | 5 |

The complete disclosure of the patents, patent documents, and publications cited in the Background, the Detailed Description of Exemplary Embodiments, and elsewhere herein are incorporated by reference in their entirety as if each were individually incorporated.

Illustrative embodiments of this invention are discussed and reference has been made to possible variations within the scope of this invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. An abrasive article 120 comprising a sleeve coupling 130 comprising a bore 132 for retaining a shaft of a driven tool;

a base plate 140 attached to the sleeve coupling;

a resiliently compressible member 150 attached to the base plate and comprising a material having an elastic modulus in a range from about 1500 Pascals to about $4.9\times10^5$ Pascals when measured at 1 Hz and 25 degrees Celsius; and an abrasive member 170 attached to the resiliently compressible member, the abrasive member comprising an abrasive surface having an area of about 300 square millimeters ($mm^2$) or less;

wherein the resiliently compressible member separates the abrasive member from the base plate and provides torsional flex such that the resiliently compressible member and the abrasive member may twist relative to the base plate in response to changes in a rotational direction of the shaft.

2. The abrasive article of claim 1 wherein the resiliently compressible member comprises a material selected from the group consisting of styrene-butadiene-styrene/oil gels having an elastic modulus of 1992 Pascals at 1 Hz and 25° C., urethane foam having an elastic modulus of $3.02\times10^5$ Pascals at 1 Hz and 25° C., urethane foam having an elastic modulus of $4.31\times10^5$ Pascals at 1 Hz and 25° C., elastomeric urethane rubber having an elastic modulus of $4.89\times10^5$ Pascals at 1 Hz and 25° C., and combinations thereof.

3. The abrasive article of claim 1 wherein the resiliently compressible member comprises a material having an elastic modulus in a range from about 1750 Pascals to about $1.5\times10^5$ Pascals when measured at 1 Hz and 25 degrees Celsius.

4. The abrasive article of claim 1 wherein the thickness of the resiliently compressible member between the base plate and the abrasive member is substantially uniform.

5. The abrasive article of claim 1 wherein the abrasive member is supported by a support layer positioned between the resiliently compressible member and the abrasive member.

6. The abrasive article of claim 1 wherein the bore comprises a shape complementary to the shaft, the bore being configured to attach to the shaft by way of friction-fit components.

7. The abrasive article of claim 1 wherein the base plate comprises a mounting surface and the resiliently compressible member comprises a first major surface facing the mounting surface, wherein the first major surface of the resiliently compressible member is as large or larger than the mounting surface of the base plate.

8. The abrasive article of claim 1 wherein the base plate comprises a mounting surface and the resiliently compressible member comprises a second major surface facing away from the mounting surface, wherein the second major surface of the resiliently compressible member is as large or larger than the mounting surface of the base plate.

9. The abrasive article of claim 7 wherein the resiliently compressible member comprises a second major surface facing away from the mounting surface, wherein the second major surface of the resiliently compressible member is as large or larger than the mounting surface of the base plate.

10. The abrasive article of claim 1 wherein the resiliently compressible member comprises a second major surface facing away from the base plate and the abrasive member comprises a major surface facing the resiliently compressible member, the major surface of the abrasive member being larger than the second major surface of the resiliently compressible member.

11. The abrasive article of claim 7 wherein the resiliently compressible member comprises a second major surface facing away from the base plate and the abrasive member comprises a major surface facing the resiliently compressible member, the major surface of the abrasive member being larger than the second major surface of the resiliently compressible member.

12. The abrasive article of claim 8 wherein the abrasive member comprises a major surface facing the resiliently compressible member, the major surface of the abrasive member being larger than the second major surface of the resiliently compressible member.

13. The abrasive article of claim 9 wherein the abrasive member comprises a major surface facing the resiliently compressible member, the major surface of the abrasive member being larger than the second major surface of the resiliently compressible member.

14. The abrasive article of claim 1 wherein the resiliently compressible member is disc-shaped.

15. The abrasive article of claim 1 wherein the resiliently compressible member has a thickness of 1.5 mm or more.

16. The abrasive article of claim 1 wherein the abrasive member comprises an abrasive surface, wherein a majority of the abrasive surface remains in contact with a flat portion of the surface of a workpiece that is being abraded when an axis of rotation of the abrasive article is not normal to a flat portion of the surface of the workpiece.

17. The abrasive article of claim 16 wherein when the abrasive article is not in use, the abrasive surface is oriented perpendicular to the sleeve coupling.

18. The abrasive article of claim 1 wherein the resiliently compressible member is reducible in volume by at least 10% in response to an applied compressive force, and, further wherein the resiliently compressible member regains at least 50% of the reduced volume after removal of the compressive force within one minute or less.

* * * * *

UNITED STATES PATENT AND TRADEMARK OFFICE

CERTIFICATE OF CORRECTION

PATENT NO. : 8,758,089 B2
APPLICATION NO. : 13/563986
DATED : June 24, 2014
INVENTOR(S) : Michael Annen It is certified that error appears in the above-identified patent and that said Letters Patent is hereby corrected as shown below:

IN THE SPECIFICATION:

Col. 2, Line 30, delete "centimeters)," and insert -- centimeters)), --

Col. 18, line 8, delete "backing Embossed" and insert -- backing. Embossed --

Col. 19, line 9, delete "VB, VIIB," and insert -- VB, VIB, --

Col. 21, line 5, delete "disperant" and insert -- dispersant --

Col. 24, line 37, delete "Noble, Narcross," and insert -- Noble, Norcross, --

Signed and Sealed this
Thirtieth Day of December, 2014

Michelle K. Lee

Michelle K. Lee
*Deputy Director of the United States Patent and Trademark Office*